US007930832B2

(12) United States Patent
Kind

(10) Patent No.: US 7,930,832 B2
(45) Date of Patent: Apr. 26, 2011

(54) RIM UNROLLER FOR PAPER CUPS

(76) Inventor: Paul G. Kind, Russell (CA)

( * ) Notice: Subject to any disclaimer, the term of this patent is extended or adjusted under 35 U.S.C. 154(b) by 664 days.

(21) Appl. No.: 11/801,422

(22) Filed: May 9, 2007

(65) Prior Publication Data

US 2007/0265152 A1 Nov. 15, 2007

Related U.S. Application Data

(60) Provisional application No. 60/798,660, filed on May 9, 2006.

(51) Int. Cl.
*B26B 17/00* (2006.01)
*B31B 1/00* (2006.01)

(52) U.S. Cl. ..... 30/178; 30/229; 83/589; 493/158

(58) Field of Classification Search ..... 30/105, 30/102, 101, 400, 402, 410, 414, 436, 178, 30/134, 229, 262, 28, 363, 358, 293, 287; 493/158; 83/13, 589; 7/156; 225/96, 103; 81/3.07; D8/52
See application file for complete search history.

(56) References Cited

U.S. PATENT DOCUMENTS

| | | | | |
|---|---|---|---|---|
| 450,703 | A * | 4/1891 | Price | 30/28 |
| 2,742,696 | A * | 4/1956 | Williams | 30/128 |
| 2,901,933 | A * | 9/1959 | Wieser | 30/91.2 |
| 4,518,639 | A | 5/1985 | Phillips | 428/35 |
| 4,817,287 | A * | 4/1989 | Arnold et al. | 30/178 |
| 4,852,255 | A | 8/1989 | Hockfeld | 30/102 |
| 4,987,683 | A * | 1/1991 | Brych | 30/363 |
| 5,036,590 | A | 8/1991 | Reinke | 30/304 |
| 6,840,078 | B1 | 1/2005 | Clover | 72/326 |
| 2001/0025422 | A1 * | 10/2001 | Momosaki | 30/178 |

FOREIGN PATENT DOCUMENTS

| | | |
|---|---|---|
| CA | 2372845 | 8/2003 |

OTHER PUBLICATIONS

PCT/US07/11248 ISR and Written Opinion, Mar. 24, 2008.

* cited by examiner

*Primary Examiner* — Ghassem Alie
(74) *Attorney, Agent, or Firm* — Abelman, Frayne & Schwab; Ralph J. Crispino

(57) ABSTRACT

A device is provided for unrolling a rim of a container, such as a paper cup. The device includes a first structure or section with an inside surface, a first end and a second end, including a pair of spaced apart cutting blades projecting from the inside surface. Attached or integrated proximate the second end of the first structure is a second structure or section with a first end and a second end. The cutting blades are accessible via a juncture at the first end of the first structure and the first end of the second structure. Accordingly, the device may be used to cut and unroll a portion of a rim of a container such as a paper cup.

15 Claims, 4 Drawing Sheets

RIM UNROLLER FOR PAPER CUPS

RELATED APPLICATIONS

This application claims priority to U.S. Provisional Patent Application Ser. No. 60/798,660, filed on May 9, 2006, which is incorporated by reference herein in its entirety.

BACKGROUND

1. Technical Field

This invention relates generally to the field of paper cup rim unrolling devices.

2. Description of the Prior Art

It is very common for entities to offer promotions. Marketing of consumer products such as foods, beverages, household products and the like is highly competitive. Various methods exist for advertising and promoting the sale of such products and oftentimes related products. Many such products are sold in containers having rolled rims, such as paper cups used in serving hot or cold beverages, hot or cold food products (e.g., soups, popcorn, prepared foods, yogurt, ice cream), and other food products (e.g., cups served with assorted snacks, nuts). Further, such containers are used in other products, such as various craft materials and construction materials, such as various powders and the like.

One example of the application of promotional and/or contest materials under the rim of a container is the "Roll up the Rim to Win®" contest offered by Tim Hortons, Inc. (Oakville, ON, Canada). In the contest, customers may receive and roll up the rim on specially marked Tim Hortons hot drink take-out contest cups. Revealed inside the rim will be a "Win" or "Play Again" message. A "Win" message will describe the specific prize available to be won.

U.S. Pat. No. 4,518,639 shows a cup formed with a perforated notch on the body of the cup intended to be pulled upwards in order to reveal the code or message under the rim. However, this adds additional inconvenience in manufacturing the cup as compared to being able to offer a product where a code, message or other information is presented under the rolled rim, which may be conveniently printed during manufacture.

Canadian Patent Application Number CA 2372845, now abandoned, discloses a device for unrolling a rolled rim of a cup including a U shaped structure having blade members positioned at a base of the U shape. In use, one must push the device virtually to the full depth of the U shape in order to make a pair of cuts along a circumferential length of the outwardly projecting rim of the cup. Further, the user must take great care in removing the device to ensure that the rim is appropriately positioned relative to the unrolling member of the device so that it is pulled open. In addition, this design may tend only to provide notches at the edges of the region of the rim to be rolled, whereby the individual must complete unrolling by hand.

Therefore, a need remains for an apparatus that allows one to conveniently cut and unroll a portion of a rim of a paper cup.

BRIEF SUMMARY OF THE INVENTION

A device is provided for unrolling a rim of a container, such as a paper cup. The device includes a first structure or section with an inside surface, a first end and a second end, including a pair of spaced apart cutting blades projecting from the inside surface. Attached or integrated proximate the second end of the first structure is a second structure or section with a first end and a second end. The cutting blades are accessible via a juncture at the first end of the first structure and the first end of the second structure. Accordingly, the device may be used to cut and unroll a portion of a rim of a container such as a paper cup.

BRIEF DESCRIPTION OF THE FIGURES

The foregoing summary as well as the following detailed description of preferred embodiments of the invention will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings, where.

DETAILED DESCRIPTION OF THE FIGURES

Figure 1:
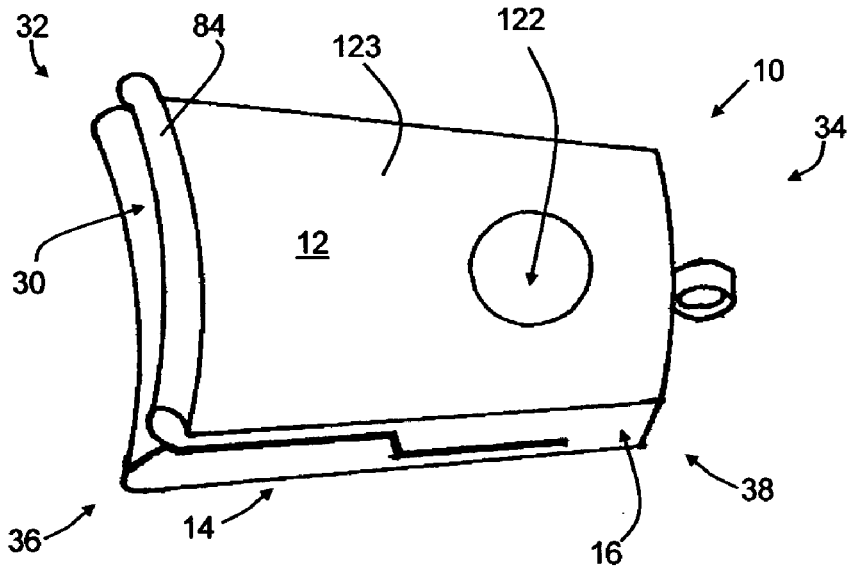
FIG. 1 is a perspective top view of a device for cutting and unrolling a rim of a container according to certain embodiments of the present invention.
Figure 2:
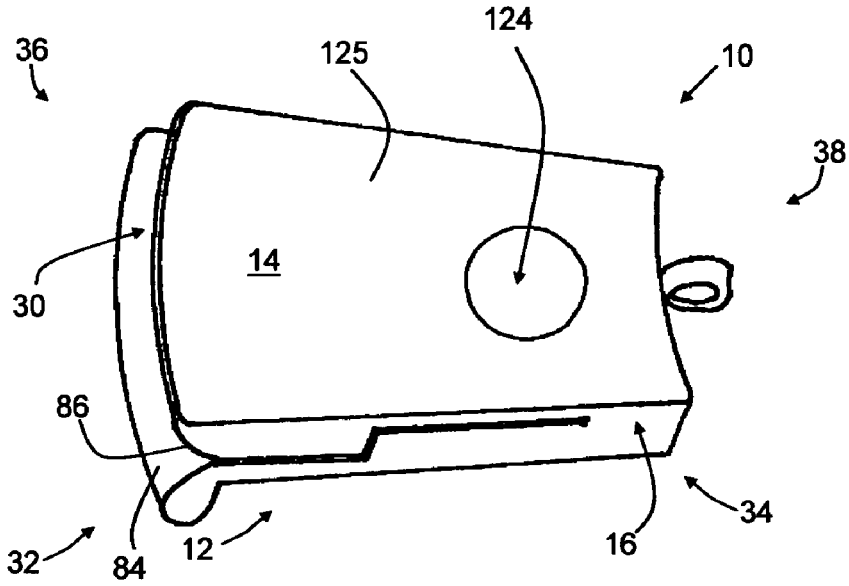
FIG. 2 shows a perspective bottom view of the device of FIG. 1.
Figure 3:
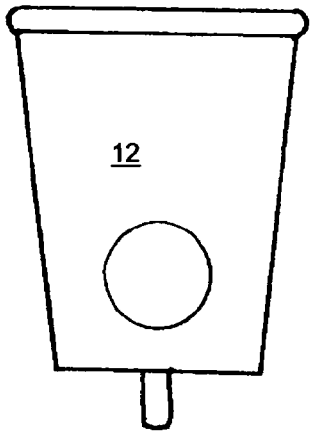
FIG. 3 shows a top plan view of the device of FIG. 1.
Figure 4:
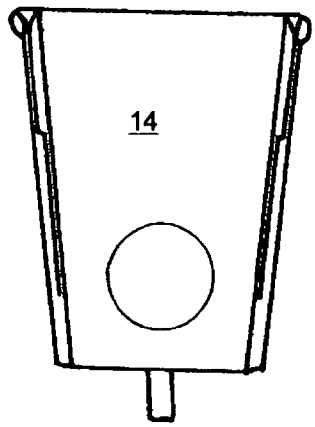
FIG. 4 shows a bottom plan view of the device of FIG. 1.

An apparatus is provided herein for unrolling the rim of a cup, for example, as presented in various contests and the like as described above in the Description of the Prior Art. Now referring to FIGS. 1-9 in general, an example of a device 10 for unrolling a rim of a container is shown. In general, device 10 includes a first structure 12 with an inside surface 13 having a pair of projecting spaced apart cutting blades 18, 20, and a second structure 14 having an inner surface 15 attached to 16 or at least partially integral with 16 the first structure 12. As shown in the Figures, the first structure 12 includes a first end 32 and a second end 34, and the second structure 14 includes a first end 36 and a second end 38. As shown, the attachment 16 or integration 16 of the first and second structures 12, 14 is located proximate the second ends 34, 38. The first and second structures are attached 16 or integrated 16 with sufficient strength and allowing sufficient flexibility (or alternatively hinge action) permitting first ends 32, 36 to separate a sufficient distance to allow a rim of a container to be inserted in the juncture 30 (whereby in the figures, reference numeral 30*a* indicated the closed position and reference numeral 30*b* indicates the open position). For instance, the first and second structures 12, 14 may be attached 16 with a suitable adhesive and/or structural features. In certain embodiments, the first and second structures 12, 14 may be attached 16 with a suitable hinge or spring. In still further embodiments, the first and second structures 12, 14 may be integrated 16, for instance, by integrally molding both structures as a monolithic structure.

Generally, the first structure 12 serves to support the cutting blades 18, 20. These cutting blades 18, 20 are positioned at a location along the first structure suitable to allow one to insert the rim of a container completely past the blades. As the rim is pulled back out of the device 10, the blades cut (or re-cut as described further herein) the periphery of the portion of the rim to be unrolled and provides a surface (the pulling portion 26) that facilitates unrolling of the rim.

Figure 5:
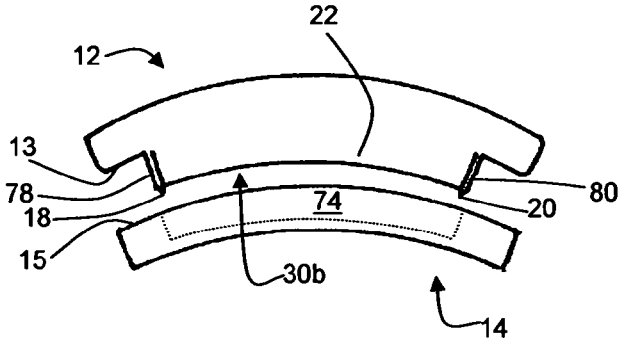
FIG. 5 shows a front view of the device of FIG. 1 in an open position (e.g., when a rim of a container is inserted therebetween)
Figure 6:
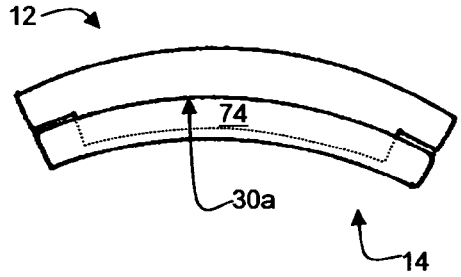
FIG. 6 shows a front view of the device of FIG. 1 in an closed position.
Figure 7:
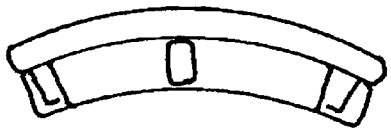
FIG. 7 shows a back view of the device of FIG. 1.
Figure 8:
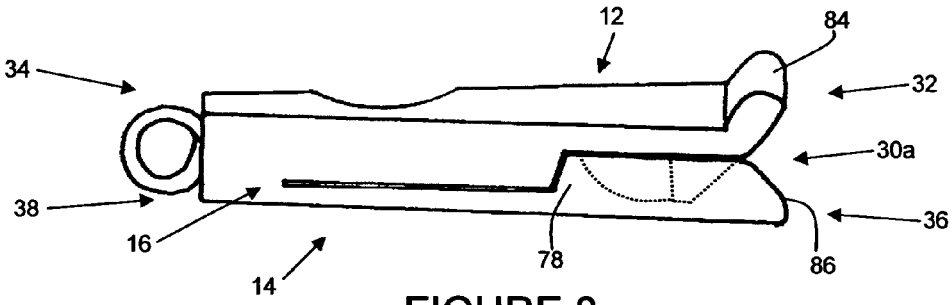
FIG. 8 shows a side view of the device of FIG. 1 in a closed position (showing a blade and contact portion in dotted lines behind)
Figure 9:
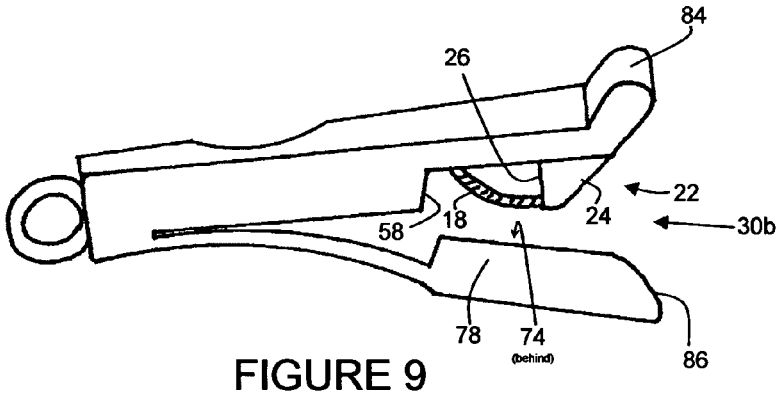
FIG. 9 shows a side view of the device of FIG. 1 in an open position.

Referring in particular to FIGS. 5 and 9, the first structure 12 includes at least one contact region 22 between the cutting blades 18, 20. In certain embodiments, one or more contact regions 22 are provided in front of the blades 18, 20. The contact regions 22 includes a guide portion 24 generally configured, positioned and dimensioned for contacting the top and outside portions of a rim of a cup. For instance, the guide portion 24 may include one or more sloped edges or surfaces sloping to a height approximately equal to or approaching the maximum height of the cutting blades 18, 20. The contact regions 22 further includes a pulling portion 26, generally configured, positioned and dimensioned for contacting the underside of a rim. Accordingly, when the cutting blades 18, 20 have cut into a rim, and as the device 10 is pulled away from the container (or the container pulled away from the device 10), the rim is unrolled due to the raking force of the pulling portion 26 against the underside of the rim. For instance, in certain embodiments, the pulling portion 26 may be configured approximately perpendicular to the inside surface 13.

The first structure 12 may further include a pair of edges 58, 60 (e.g., of wall portions or other protrusions) behind (and spaced apart a wider distance than) the pair of cutting blades 18, 20. These edges 58, 60 may serve to provide a guide stop for a portion of a rim of a container after it is cut by the insertion of the rim into the device 10, and before it is pulled out of the device 10. However, other structures, for instance, posts or other features protruding from the first surface, may form the guide stops 58, 60. Thus, in certain preferred embodiments, guide stops are provided to provide gaps 59, 61 (FIG. 12) between the ends of the cutting blades (opposite the first end 32) and the guide stops 58, 60. These gaps may be dimensioned such that, for example, the rim is held firmly in place so that separate cuts are not formed upon removal of the rim from the device.

Generally, the second structure 14 serves to guide and compress the inside surface of the container proximate the rim. For instance, the second structure 14 may include one or more portions 72 (shown in FIG. 11) configured for contacting and guiding the inside of a container having a rim. These portions 72 may be formed to dimensions allowing it to maintain contact and structural support with the inside surface of a container during rim cutting and unrolling, thereby minimizing the effort required to cut and unroll the rim. In addition, the second structure 14 includes a region 74 (shown behind in FIG. 9), for instance, for having recessed therein the cutting blades 18, 20 when the device 10 is a closed position 30*a*. Furthermore, regions 110 are provided to accommodate the contact region(s) 22 of the first structure 12 when the device 10 is a closed position 30*a*. For additional safety, a pair of wall portions 78, 80 may be provided outside of the cutting blades 18, 20. With these wall portions 78, 80, the blades and inner structures of the device 10 are concealed, rather than exposed, which may prevent injury and entrance of foreign materials (which may dull the blades).

The cutting blades 18, 20 are accessible at the first ends 32, 36 at the juncture 30 of the first and second structures 12, 14. To facilitate insertion of the rim of a cup into the device 10, the first structure 12 may include at its first end 32 an upturned portion 84 turned away from the inside surface 13, and the second structure 14 may include at its first end 36 an angled portion 86 sloped away from the inside surface 15.

Figure 10:
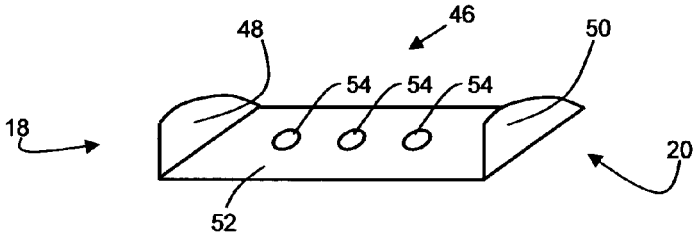
FIG. 10 shows an example of a cutting blade structure that may be used in certain embodiments of the present invention.

In certain embodiments, and referring in particular to FIG. 10, the spaced apart cutting blades 18, 20 are upturned ends 48, 50 of a blade structure 46. A central portion 52 of the blade structure 46 is configured for being supported on the inside surface 13 of the first structure 12. For example, as shown, the central portion 52 includes apertures 54 to be supported by corresponding posts 114 (shown in FIG. 12) on the inside surface 13 of the first structure 12.

The cutting blades 18, 20 are generally positioned toward the first end 32. For instance, the cutting blades 18, 20 may extend to less than about ⅔ (preferably less than about ½) the distance between the first end 32 and the second end 34. Further, the guide stop edges 58, 60 may be positioned between a back end of the cutting blades 18, 20 and the second end 34, at a distance at least sufficient to allow a rim of a container to fit between the edges 58, 60 and the back end of the cutting blades 18, 20.

Figure 11:
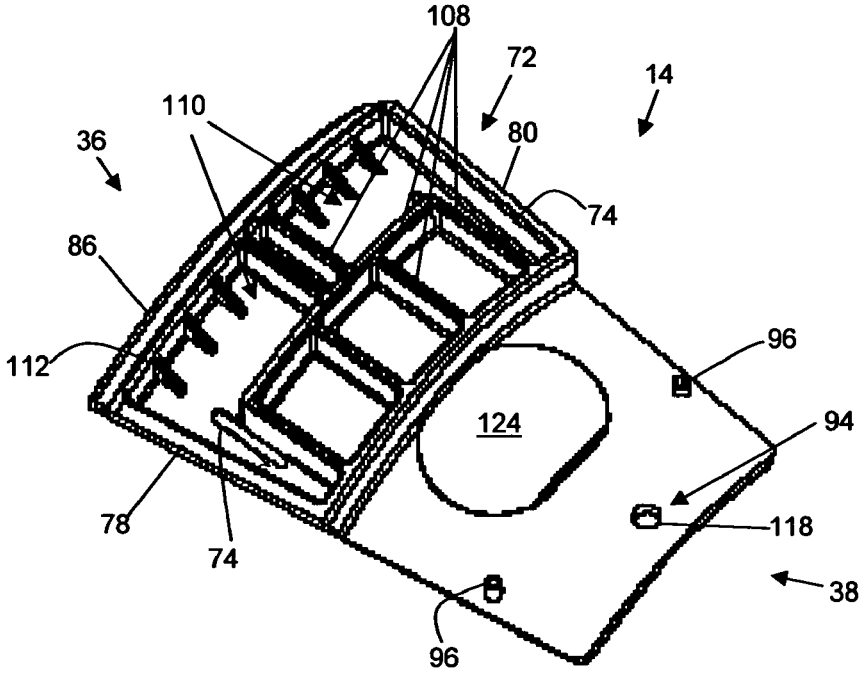
FIG. 11 shows an example of a structure of the device according to the present invention.
Figure 12:
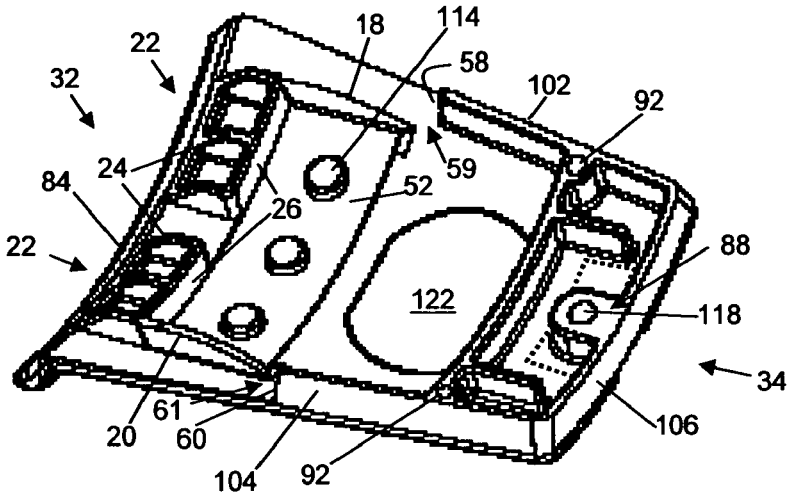
FIG. 12 shows an example of a structure of the device according to the present invention including blades therein corresponding to the structure of FIG. 11.

Referring to FIGS. 11 and 12, the first structure 12 and the second structure 14 are attached by adhering (mechanically and/or with suitable adhesive or bonding techniques) or integrally forming an attachment region 88 of the first structure proximate the second end 32 with an attachment surface 94 proximate the second end 38 of the second structure 14. The attachment region may have various dimensions and configurations. For instance, FIG. 12 shows the attachment region 88 as an area around the aperture 118 for a key ring, and also a larger region with dotted lines. Further, the attachment may also include apertures 92 for receiving corresponding protrusions 96 on the second structure 14.

Referring to FIG. 11, the second structure 14 may include a plurality of ridges 108, for instance, defining the portion 72 configured for contacting the inside of a container. These ridges 108 are generally configured to allow blades 18, 20 to fit therebetween, for instance, in region 74. Further, one or more regions 110 are defined within the portion 72 proximate the angled portion 86, to allow the contact structure 22 of the first structure to fit therebetween. Optionally, ribs 112 may be provided, formed to adjoin the edges of the guide surfaces 24 shown in FIG. 12.

Referring to FIG. 12, the first structure 12 may include side walls 102, 104 extending approximately perpendicular from outer edges of the inside surface 13. The side walls 102, 104 form the guide stop edges 58, 60 behind (and spaced apart a wider distance than) the pair of cutting blades 18, 20. Further, the first structure 12 may include an end wall 106 extending approximately perpendicular from the second end 34 outer edge. FIG. 12 also shows the contact structures 22, including guide surfaces 24 and pulling portions 26, in the form of two sets of three ridges (the top edges forming guide surfaces 24) with a wall or rib portion as the pulling portion 26.

Device 10 may optionally include an aperture 118 for accepting a key ring. For instance, as shown in FIGS. 11 and 12, the aperture 118 extends through the first and second structures 12, 14 proximate the second ends 34, 38.

Furthermore, to facilitate manipulation of the device, device 10 may optionally include concave indentations 122, 124 on the outer surfaces 123, 125 of the first structure 12 and the second structure 14.

The overall configuration of the first and second structures generally mimics that of a portion of a container. For instance, the inner surface 13 of the first structure 12 is preferably concave and the inner surface 15 of the second structure 14 is preferably convex, in order to facilitate insertion over a cylindrical or cup shaped container.

Furthermore, as shown, the first structure 12 and the second structure 14 may optionally be configured as isosceles trapezoids with the wide base at first ends 32, 36 and the narrow base at second ends 34, 38.

In one embodiment, for standard consumer beverage cups, a device may be provided as shown in FIGS. 11 and 12. The overall length of the isosceles trapezoid formed by the device 10 (the combination of first structure 12 and second structure 14) may be about 2.0 inches, with the wide end of the device 10 being about 1.6 inches, and the narrow end being about 1.2 inches. The first structure 12 may have a radius of about 1.3 inches at the outer surface 123 proximate end 32, and the second structure 14 may have a radius of about 1.5 inches at the inner surface 15. The device 10 may have an overall thickness of about 0.25 inches at the wide end proximate the upturned portion 84 and angled portion 86 and an overall thickness of about 0.2 inches at the narrow end. Further, the cutting blades 18, 20 may have a front to back dimension about 0.46 inches, and may be spaced apart about 1.12 inches. Each blade may have a starting (i.e., proximate the juncture 30) height of 0.12 inches to a max height of 0.15 inches at 0.1 inches depth (front to back) curving downward to 0 inches at the back end. The blades may be positioned toward the juncture 30, for instance, about 0.28 inches from start of the upturned portion 84. The contact structure 22 may be about 0.28 inches depth (between the juncture 30 and the blade), 0.12 inches height at juncture of blade (remaining constant for about 0.12 inches), sloping in the remaining 0.16 inches depth to 0 height. As shown in FIG. 12, the contact structures 22 may each be about 0.47 inches wide having two 0.15 inch wide cut-out regions leaving end walls and back walls having a thickness about 0.03 inches and a center wall having a thickness of about 0.06 inches, with a front sloped portion of about 0.06 inches. These contact structures 22 are positioned between the cutting blades 18, 20 and the first end 32 (at the start of the upturned portion 18).

The structures 12, 14 and the various portions thereon described herein may be formed of any suitable material. In certain embodiments, the structures 12, 14, may be formed of semi-rigid plastic materials, such that some degree of flex is provided. For instance, a suitable semi-rigid plastic material includes acrylonitrile butadiene styrene (ABS) plastic material.

In addition to the configuration shown, e.g., the rim roller device with an integral key ring (or key ring aperture), the rim roller device may be integrated with other devices to form multi-tools such as bottle openers, pocket knives, flashlights, and other common devices. Furthermore, the outer surfaces 123, 125 may bear suitable logos and/or indicia, for instance, as advertising materials, promotional information, personalized information, or other indicia and/or text.

Having generally described the structure of a device 10, a method of its operation will now be described in further detail. The rim of a container is aligned with the device 10 so that the position between cutting blades 18, 20 encompasses the area to be cut and unrolled. The rim is inserted in the juncture 30. In certain embodiments described in greater detail below, portions of the rim are cut during insertion by the blades 18, 20, and re-cut as the container is removed and the rim is unrolled. Further, in alternative embodiments, cutting during insertion is optional, that is, a user must squeeze or pinch the device 10 to compress the structures 12, 14 together to cut the rim.

In certain embodiments, compression forces may be imparted on the rim by the device 10, in particular where the cuts are being formed by the cutting blades 18, 20. For instance, the attachment 16 or integration 16 may provide compression forces on the rim during insertion and removal of the rim of the container. During insertion, the insertion forces of the user inserting the rim at the juncture 30*a* forces it to open 30*b* and slide to the blades 18, 20. When the rim is exposed to the blades, compression forces cause the blades to easily slice through the rim, and this the rim is seated substantially on the surface 13 of the first structure 18, while the inside of the cup is contacted by the second structure 14. In certain embodiments, as described above, the outer surface of the rim of the container contacts the contact structure 22, including the guide surface 24, before the rim is exposed to the cutting blades 18, 20. Further, as the rim passes the length of the blades, the rim may "seat" on the surface 13 within a region of the first structure proximate or adjacent to the edges 58, 60, i.e., as guides stops.

These compression forces accordingly can assist in cutting action of blades 18, 20 to create the outer boundaries of the portion of the rim to be unrolled during insertion, as an insertion cut. Further, in certain embodiments, the components may be formed of semi-rigid material (e.g., having properties similar to acrylonitrile butadiene styrene), whereby compression forces due in part to the flexing of the components also impart force on a rim of a container after it is inserted in juncture 30 to assist in cutting action of blades 18, 20. In addition, in certain embodiments, the first and second structure 12, 14 may be formed in a preloaded state, for example, by angling the components together in a loaded condition during attachment or molding. Any or all of the above mentioned compression forces may be assisted by the user pinching or squeezing the device 10 to impart additional compression forces. Note, however, that in certain preferred embodiments, the various features of the first and second structures 12, 14 are configured and dimensioned accordingly, and the blades 18, 20 are configured and dimensioned accordingly, in order to prevent a user from over-cutting, or cutting the container in addition to the rim.

The action of unrolling the rim of the container is completed by pulling back the device 10 (or pulling away the container, or both), whereby the outer boundaries of the portion of the rim to be unrolled are re-cut by the blades 18, 20 (removal cut), and the portion of the rim to be unrolled is contacted and unrolled by the pulling portion 26.

In alternative embodiments, the attachment 16 or integration 16 may allow the device to open at the juncture 30 to insert the rim of the container to expose it to the cutting blades 18, 20, but without the above described feature of imparting compression forces, for instance, with a suitable passive hinge. The action of unrolling the rim of the container is completed by pulling back the device 10 (or pulling away the container, or both), whereby the outer boundaries of the portion of the rim to be unrolled are cut by the blades 18, 20 (removal cut), and the portion of the rim to be unrolled is contacted and unrolled by the pulling portion 26. The user may impart compression forces, for example, by squeezing or pinching the device 10 while the container is removed from the device 10. Further, the user may also impart the squeezing or pinching force while the rim of the container is being inserted through the juncture 30 thereby providing an insertion cut similar to that described above in the embodiment where there is compression in the device.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A device for unrolling a rim of a container comprising:

a first structure with an inside surface a first end and a second end, including a pair of spaced apart cutting blades projecting from the inside surface positioned proximate to the first end of the first structure, and configured and dimensioned for defining a portion of a rim of a container between the cutting blades to be notched, a contact region between an end of each of the cutting blades proximate the first end, and the first end of the first structure, and extending at least a portion of the distance between the cutting blades, and a pulling portion at a back end of the contact region between the cutting blades configured and dimensioned for contacting the underside of the portion of the rim; and a second structure with a first end and a second end attached to or at least partially integral with the first structure, the second structure including concealing walls outside of the spaced as art cutting blades configured, positioned and dimensioned for concealing the cutting blades;

wherein the first structure and the second structure are attached or integrated proximate the second end of the first structure and the second end of the second structure, the first structure and the second structure being attached or integrated with a degree of flexibility so as to define a closed position in which the cutting blades are concealed by the concealing walls of the second structure and the contact region of the first structure, and an open position when a rim of a container is inserted between the first structure and the second structure; and wherein the cutting blades are slidably accessible when the device is in the open position by insertion of the device over a rim of a container via a juncture of the first end of the first structure and the first end of the second structure.

2. The device as in claim 1, wherein the cutting blades extend to less than about ⅔ of the distance between the first end and the second end of the first structure.

3. The device as in claim 1, wherein the cutting blades extend to less than about ½ of the distance between the first end and the second end of the first structure.

4. The device as in claim 1, further comprising a guide stop positioned between an end of the cutting blade opposite from the first end of the first structure and the second end, wherein a gap is provided between the guide stop and the end of the cutting blade.

5. The device as in claim 1, wherein the contact region includes a guide portion configured for contacting the top and outside portions of a rim.

6. The device as in claim 1, wherein the contact region includes a guide portion configured with one or more sloped edges or surfaces sloping to a height approximately equal to or approaching the maximum height of the cutting blades.

7. The device as in claim 1, wherein the pulling portion is configured approximately perpendicular to the inside surface of the first structure.

8. The device as in claim 1, wherein the attachment or integration of the first structure and the second structure provides compressive forces to a rim to be cut by the cutting blades.

9. The device as in claim 1, wherein the second structure includes a portion configured for contacting the inside of a container having a rim.

10. The device as in claim 1, wherein the second structure includes one or more regions configured for accommodating the cutting blades when the device is in the closed position.

11. The device as in claim 1, wherein the first structure includes at its first end an upturned portion turned away from the inside surface.

12. The device as in claim 1, wherein the second structure includes at its first end an angled portion sloped away from an inside surface of the second structure.

13. The device as in claim 1, wherein the inner surface of the first structure is concave and the inner surface of the second structure is convex to facilitate insertion over a cylindrical or cup shaped container.

14. The device as in claim 1, wherein the first structure and the second structure are configured as isosceles trapezoids with the wide base at the first ends and the narrow base at the second ends.

15. The device as in claim 1, wherein the cutting blades comprise upturned ends of a blade structure, and wherein a central portion of the blade structure is configured for being supported on the inside surface of the first structure.

* * * * *